United States Patent [19]

Arendt

[11] 4,249,400

[45] Feb. 10, 1981

[54] WATER-EXTRACTION PRESS

[76] Inventor: Hans F. Arendt, Bleichinsel, D-7120 Bietigheim, Fed. Rep. of Germany

[21] Appl. No.: 97,392

[22] Filed: Nov. 26, 1979

[30] Foreign Application Priority Data

Dec. 7, 1978 [DE] Fed. Rep. of Germany ..... 2852923

[51] Int. Cl.[3] ..... D06F 47/06

[52] U.S. Cl. ..... 68/242; 100/116; 100/211; 100/215; 100/218

[58] Field of Search ..... 68/242, 21, 96, 210; 100/116, 211, 215, 218; 425/389, 390

[56] References Cited

U.S. PATENT DOCUMENTS 3,924,425 12/1975 Arendt ..... 68/242

FOREIGN PATENT DOCUMENTS 2602845 7/1976 Fed. Rep. of Germany ..... 68/21

*Primary Examiner*—Philip R. Coe

*Attorney, Agent, or Firm*—Berman, Aisenberg & Platt

[57] ABSTRACT

A press for extracting water from wet washing comprises a housing, a perforated press floor for supporting a batch of wet washing, and a hydraulic ram for pressing the wet washing down against the press floor. The hydraulic ram is constituted by a generally bell-shaped diaphragm carrier whose open end is closed by a bowed-in, flexible diaphragm. The hollow interior of the diaphragm carrier is pressurizable with hydraulic fluid. A charging frame is provided to assist with the uniform pressing of wet washing while helping prevent damage to the washing arising from jamming. The charging frame is movable with the diaphragm carrier towards the press floor.

19 Claims, 11 Drawing Figures

WATER-EXTRACTION PRESS

BACKGROUND TO THE INVENTION

This invention relates to a press for extracting water from wet washing.

In a known water-extraction press, wet washing is deposited in a pressure vessel whose lower walls and floor are perforated. Water is extracted from the wet washing by means of a hydraulically-operated piston which is driven into the pressure vessel to squeeze water out of the washing. After the pressing operation, the pressure vessel is opened and the "dried" washing removed. This type of press has the usual disadvantage of all piston presses. Thus, any batch of washing having an irregular outline is pressed out irregularly. Moreover, articles of washing are frequently jammed between the piston and the wall of the pressure vessel and damaged.

In another known type of press, the piston takes the form of a bell-shaped, flexible diaphragm carrier whose lower, open end is closed by a diaphragm. The diaphragm is domed into the hollow interior of the carrier which can be pressurized with hydraulic fluid. During the pressing operation, the diaphragm tends to adapt its shape to the contour of the batch of washing being pressed. Unfortunately, batches of washing pressed in this manner tend to fall apart after removal from the press. Moreover, the washing tends to jam between the edge of the diaphragm and the press floor which leads to damage, particularly in fabrics having a high proportion of synthetic fibres which are resilient after being pressed when wet.

The aim of the invention is to produce a water-extraction press which does not suffer from these disadvantages.

SUMMARY OF THE INVENTION

The present invention provides a press for extracting water from wet washing, the press comprising a housing, a perforated press floor for supporting a batch of wet washing, and a hydraulic ram for pressing the wet washing down against the press floor, the hydraulic ram being constituted by a generally bell-shaped diaphragm carrier whose open end is closed by a diaphragm and whose hollow interior is pressurisable with hydraulic fluid, wherein a charging frame is provided, the charging frame being movable with the diaphragm carrier towards the press floor.

The provision of the charging frame helps to ensure uniform passing of the wet washing and prevents jamming of the washing between the edge of the diaphragm and the press floor.

Advantageously, the charging frame is constituted by a tubular wall provided with an outwardly-extending sealing flange at its upper end. Preferably, means are provided for locking the diaphragm carrier to the charging frame for conjoint downward movement.

Means may also be provided for locking the diaphragm carrier in its lowest position. Advantageously, said locking means comprise hydraulic ram means attached to the diaphragm carrier which engage stop members attached to the housing of the press. Preferably, a pair of hydraulic piston-and-cylinder units constitute said hydraulic ram means, each of said piston-and-cylinder units having a pair of piston rods extending in opposite directions from its cylinder, and the two piston rods extending in each direction being connected to a respective stop which co-operates with a corresponding stop member attached to the housing.

The housing may include a pair of oppositely-disposed side walls, in which case each side wall may support a respective stop member 1 which extends substantially the entire width of that wall. Preferably, each stop member is constituted by a pair of vertically-spaced rails.

Advantageously, the charging frame is vertically reciprocable by means of double-acting hydraulic piston-and-cylinder units, and the charging frame is guided for vertical reciprocation on a pair of pillars positioned at a first pair of diagonally-opposed corners of the housing. Similarly, the diaphragm carrier may be vertically reciprocable by means of a double-acting piston-and-cylinder units, and the diaphragm carrier may be guided for vertical reciprocation on a pair of pillars positioned at a second pair of diagonally-opposed corners of the housing. Advantageously, the charging frame and the diaphragm carrier are each provided with sets of rollers for engaging their respective pairs of pillars.

The press may further comprise a reservoir of hydraulic fluid and a conduit leading from the reservoir to the hollow interior of the diaphragm carrier. Preferably, the upper edge of the reservoir is positioned beneath the lower edge of the diaphragm when the diaphragm carrier is in its lowest position.

Advantageously, the diaphragm is flexible and bows into the hollow interior of the diaphragm carrier.

The press may further comprise an expeller device for removing the washing from the press floor when the water extraction process has finished. Preferably, the expeller device is constituted by a curved arm pivotally mounted on the housing just above the level of the press floor.

BRIEF DESCRIPTION OF DRAWINGS

A press for extracting water from wet washing, and constructed in accordance with the invention, will now be described, by way of example, with reference to the accompanying drawings, in which.

DESCRIPTION OF PREFERRED EMBODIMENT

Figure 1:
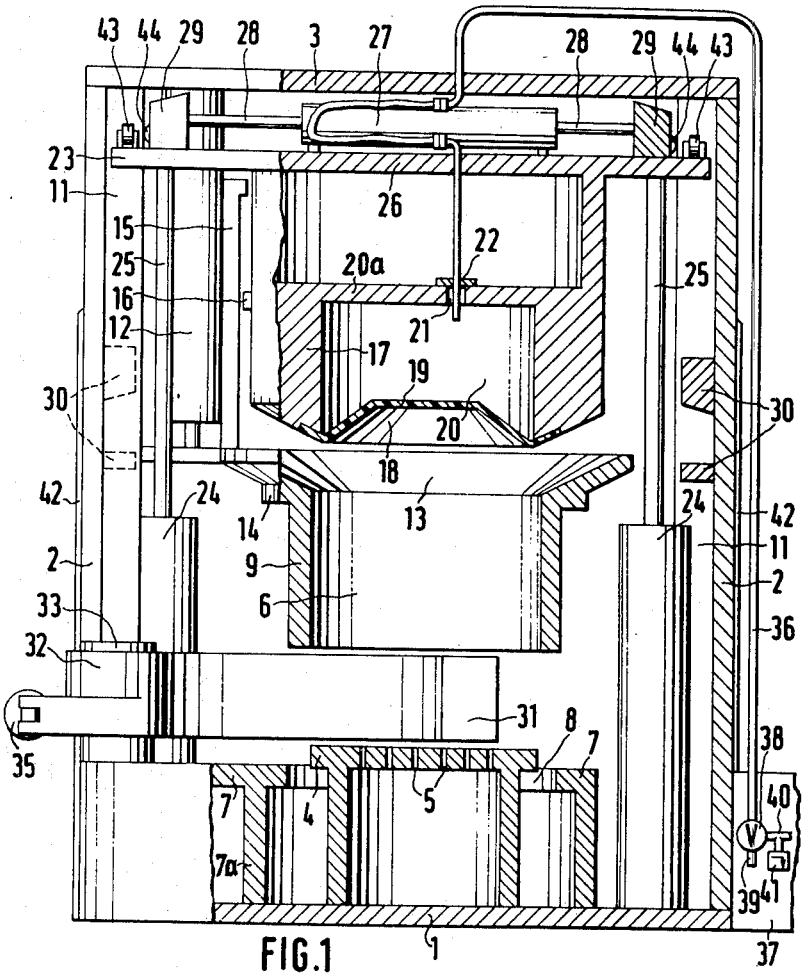
FIG. 1 is a part-sectional side elevation of the press.
Figure 2A:
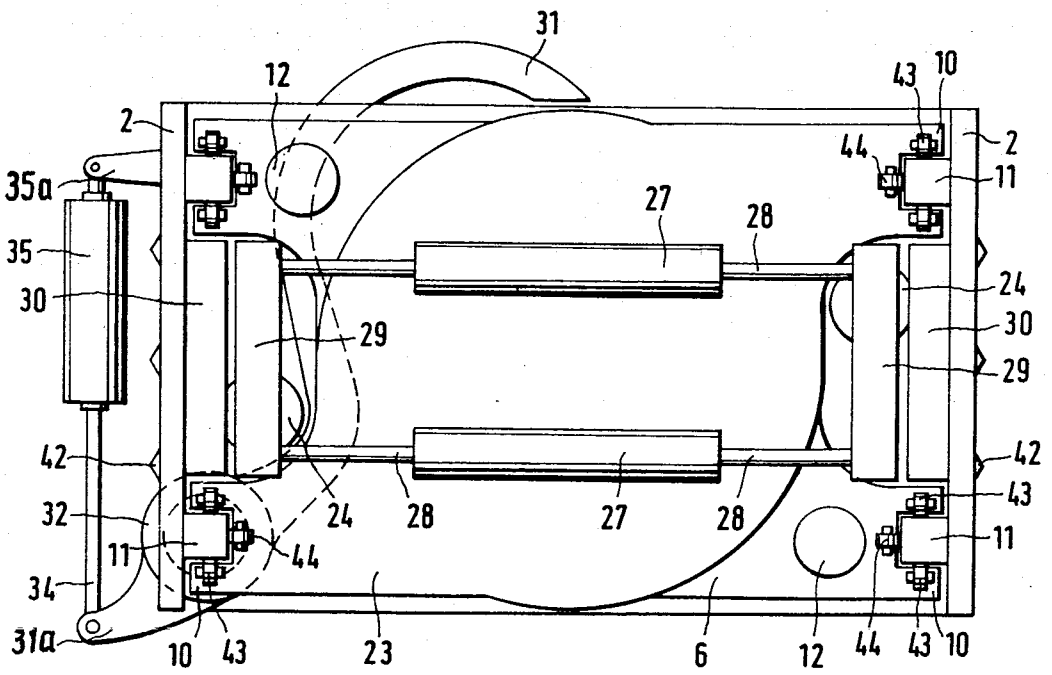
FIG. 2*a* is a plan view of the press with its top plate removed.
Figure 2B:
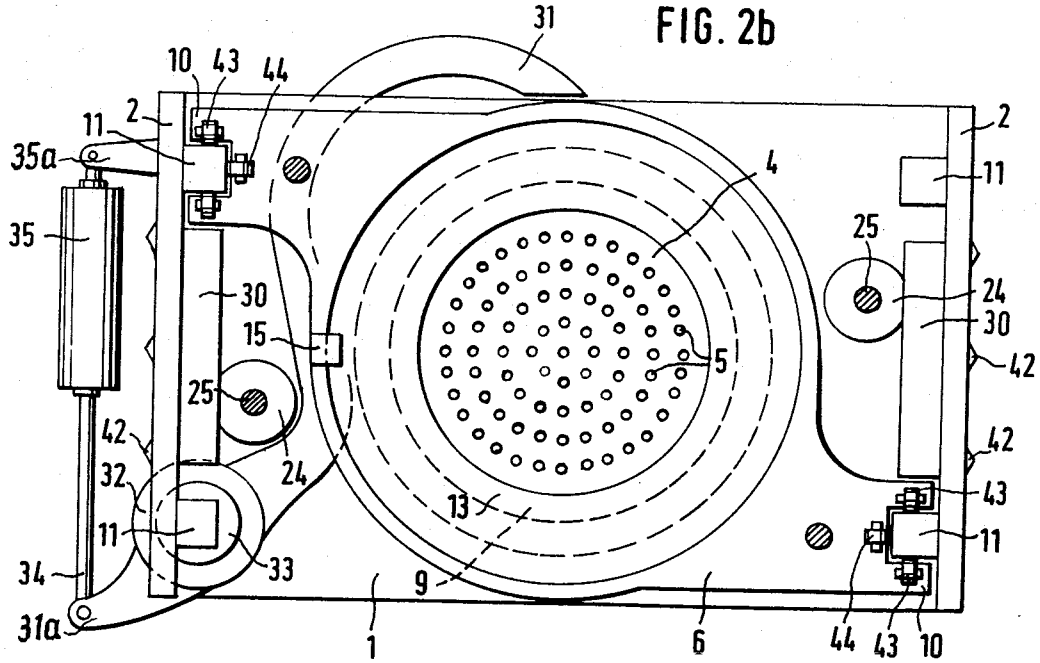
FIG. 2*b* is a plan view of the press with its top plate and diaphragm carrier removed.

Referring to the drawings, FIG. 1 shows a press having a housing constituted by a base plate 1, side walls 2 and a top plate 3. A press floor 4, provided with perforations 5 passing therethrough, is fixed to the base plate 1.

A charging frame 6 is mounted above the press floor 4, the charging frame 6 having a generally cylindrical side wall 9 which is arranged to surround the press floor when the charging frame is lowered. The press floor 4 is surrounded by an annular plate 7 which is supported on the base plate 1 by means of a cylindrical wall 7*a*. An annular gap 8 is provided in the plate 7, this gap being sized and positioned to receive the cylindrical wall 9 of the charging frame when this is lowered. The charging frame 6 is guided for vertical reciprocal movement by a pair of forks 10 which slide on a first pair of pillars 11 arranged by diagonally-opposed corners of the housing. A pair of hydraulic rams 12 are provided for reciprocating the charging frame 6, the cylinders of these rams being fixed to the top plate 3 and their piston rods being fixed to the charging frame.

The upper end of the cylindrical wall 9 of the charging frame 6 merges with a divergent, funnel-shaped flange 13. The flange 13 is provided, in the region where it merges with the cylindrical wall 9, with a downwardly-facing, horizontal support surface 14. The charging frame 6 is also provided with a stop member 15 which co-operates (in a manner described below) with a stop member 16 provided on a diaphragm carrier 17 to position the charging frame to receive batches of wet washing.

The diaphragm carrier 17 is generally bell-shaped, having a hollow interior 20 whose bottom end is closed off by a flexible diaphragm 18. The diaphragm 18 is formed with an indented portion 19 which extends into the hollow interior 20. The upper end of the hollow interior 20 is defined by an interior wall 20*a* provided with an aperture 21 covered by a sealing flange 22. The diaphragm carrier 17 has a top plate 26 provided with a pair of forks 23 which slide on a second pair of pillars 11 arranged at the other two diagonally-opposed corners of the housing. Thus, the diaphragm carrier 17 is also guided for vertical reciprocal movement within the housing, a pair of hydraulic rams 24 constituting the means for moving the diaphragm carrier. The cylinders of the rams 24 are fixed to the base plate 1, and their piston rods 25 act on the top plate 26 of the diaphragm carrier 17. The upper side of the top plate 26 also supports a further pair of hydraulic rams 27, each of which has a pair of oppositely-extending piston rods 28. Each pair of piston rods 28 extending in the same direction are connected to a respective locking member 29 which co-operates (in a manner described below) with corresponding stop members 30 provided on the side walls 2.

The press is also provided with an expeller device for removing the batches of washing once pressing has been finished. The expeller device comprises a curved arm 31 which is pivotally mounted on a vertical column 33 by means of an eye 32. An ear 31*a*, which extends from the eye 32 in a direction opposite to that in which the arm 31 extends, is connected to the piston rod 34 of a hydraulic ram 35 whose cylinder is pivotally attached to a bracket 35*a* fixed to the adjacent side wall 2.

The hydraulic system of the press includes a conduit 36 which connects a reservoir of hydraulic fluid (usually water) to the hollow interior 20 of the diaphragm carrier 17. Within the reservoir 37, the conduit is provided with a three-way valve 38 which can be switched over to connect the conduit 36 optionally to an outlet conduit 39 leading to the reservoir or to a delivery conduit 40 leading to a pump (not shown). A pressure-relief valve 41 is provided in the delivery conduit 40.

Owing to the formation of the press housing with base and top plates 1 and 3 connected by side walls 2 (instead of upper and lower frames connected by corner columns as is the case with known presses), a gantry press results in which the side walls and the top plate can be made of relatively thin material, and the side walls can be stiffened, in the regions supporting the stop members 30, by means of corrugations 42. In this case, the stop members 30 may be rails which extend over the major portions of the width of the side walls 2. Obviously, the side walls 2 are further strengthened by the corner pillars 11. This form of press housing results in a very favourable distribution of the vertical operating forces. Thus, the side walls 2 between the base plate 1 and the locking members 30 are subjected substantially only to tension forces. Any tendency for the side walls 2 to flex, arising from locking forces exerted by the rams 27, can be minimised since the locking members 29, which bear on the side walls, are relatively narrow compared with their length. Moreover, flexing of the side walls 2 is limited owing to the connection between the side walls 2 and the top plate 3.

Preferably, each of the forks 10 and 23 is guided on its pillar 11 by means of rollers 43 and 44. The provision of these rollers 43 and 44 reduces the frictional forces and facilitates the vertical reciprocation of the charging frame 6 and the diaphragm carrier 17.

Figure 3A:
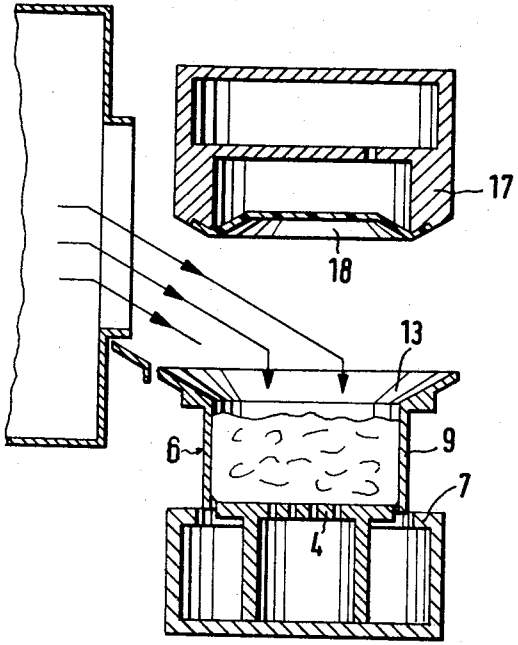
FIGS. 3*a* to 3*f* are schematic side elevations showing the various stages of operation of the press.

The press described above works as follows. Initially the charging frame 6 and the diaphragm carrier 17 are situated in their uppermost positions, that is to say in the position shown in FIG. 1. Firstly, the charging frame 6 is lowered towards the press floor 4 by pressurising the rams 12. When the charging frame 6 reaches the position shown in FIG. 3*a*, it is prevented from moving further down by its stop members 15 engaging the stop member 16 on the diaphragm carrier 17. At this stage, one or more loads of wet washing are ejected, in a conventional manner, from a washing machine or machines, the wet washing being positioned in the charging frame 6 (see FIG. 3*a*).

Figure 3B:
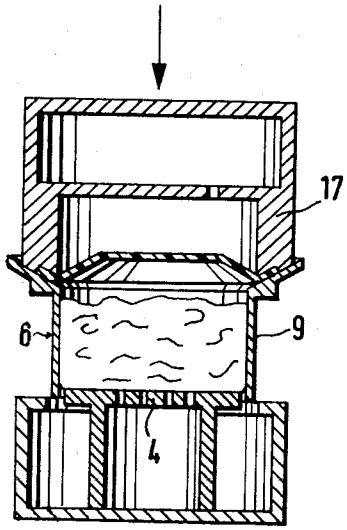
Figure 3C:
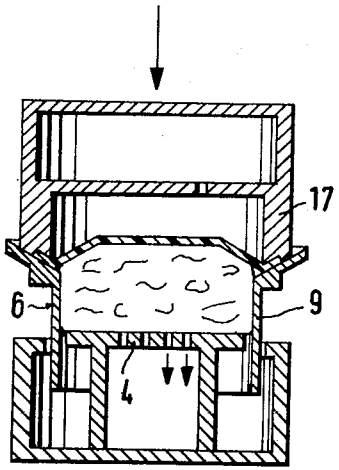
Figure 3F:
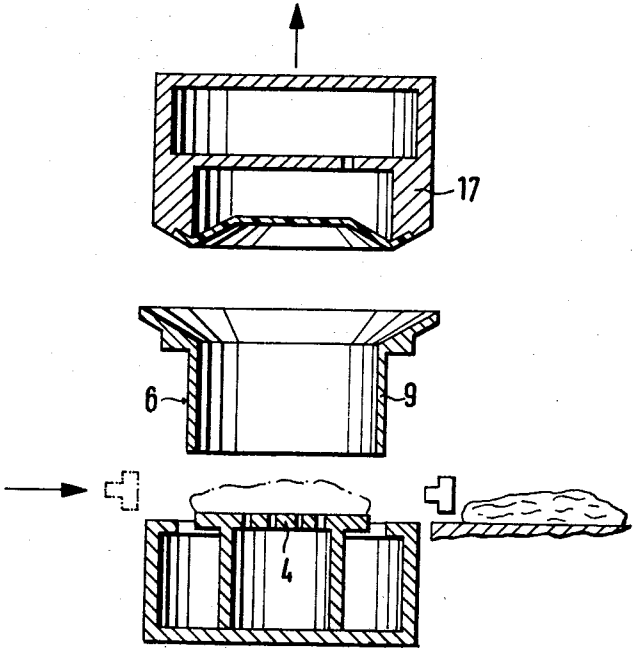

Once the charging frame 6 is fully loaded, the diaphragm carrier 17 is moved down by pressurising the rams 24. The diaphragm carrier 17 moves down until its lower end engages the flange 13 of the charging frame 6 (see FIG. 3*b*). Further downward movement of the diaphragm carrier 17 forces the charging frame 6 down as well (see FIG. 3*c*). The diaphragm carrier 17 could be mechanically locked to the charging frame 6 during this combined descent. As the diaphragm carrier approaches the charging frame 6, the diaphragm 18 engages the wet washing forcing out some water through the perforations 5 in the press floor 4. Moreover, as the charging frame 6 and diaphragm carrier 17 move down together, the wet washing (being prevented from downwards movement by the press floor 4) is pressed against the diaphragm 18 causing the diaphragm to bulge out into the hollow interior 20 of the diaphragm carrier 17. This causes further water to be forced out of the wet washing, both through the perforations 5 in the press floor 4 and through the conduit 36 to the reservoir 37. When the charging frame 6 reaches its lowest position (that is to say when its support surface 14 engages the annular plate 7), the diaphragm carrier 17 is locked in its lowest position by actuation of the rams 27 which push the locking members 29 between the locking rails 30 (see FIG. 3*d*). During the conjoint downwards movement of the diaphragm carrier 17 and the charging frame 6, the flange 13 seals against the diaphragm carrier.

Figure 3E:
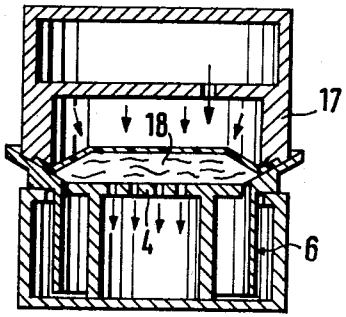
Figure 3D:
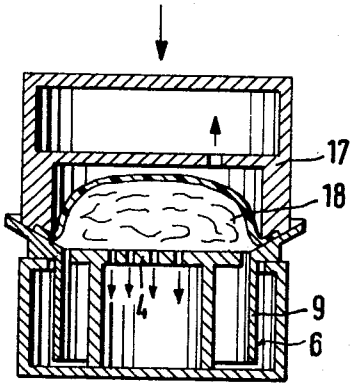

At this stage, the main water extraction process begins by pressurising the hollow interior 20 of the diaphragm carrier 17 with hydraulic fluid until the intended maximum pressure of 25 bars is reached (see FIG. 3*e*). This pressure is maintained for 30 seconds, during this time the majority of extractable water is squeezed out of the washing.

Figure 4A:
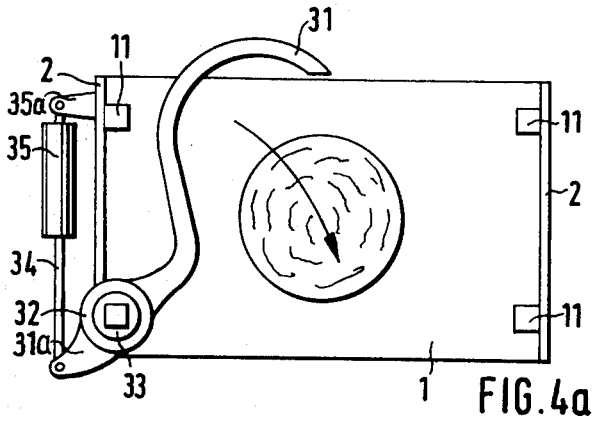
FIGS. 4*a* and 4*b* are schematic plan views showing the operation of the expeller device of the press.
Figure 4B:
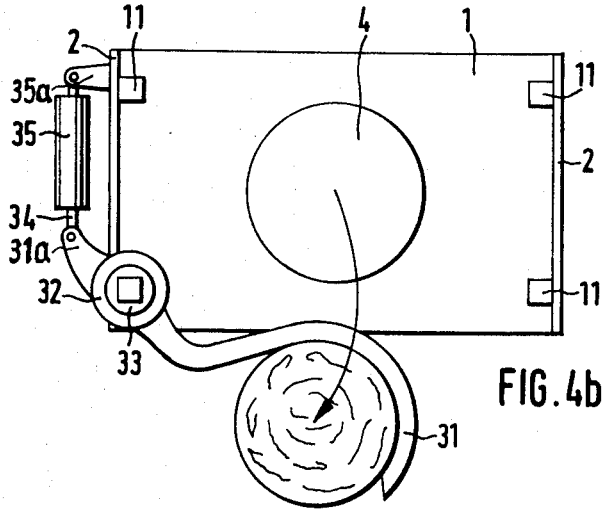

After this main extraction stage, the pressurisation of the hollow interior 20 of the diaphragm carrier 17 is briefly released, and the locking members 29 are with-drawn. The diaphragm carrier 17 and charging frame 6 are then moved upwards to their original, uppermost positions, and the "dried" batch of washing is removed from the press floor 4 by means of the expeller device (see FIG. 3*f*). This removal step is initiated by pressuring the ram 35 which rotates the arm 31 (see FIGS. 4*a* and 4*b*).

Relatively little hydraulic fluid has to be supplied during the main water extraction process, since the reservoir 37 is arranged so that its upper edge is at the level of the annular plate 7, and the diaphragm carrier 17 is above the reservoir even in its lowest position. Thus, on pressure relaxation, the hydraulic fluid flows automatically back to the reservoir 37. Moreover, the diaphragm 18 is held upwards by the static pressure gradient of the hydraulic fluid, and may even be drawn slightly further into the hollow interior 20 of the diaphragm carrier 17. Consequently, the conduit 36 does not need to be closed off in any position of the diaphragm carrier 17. In order to apply pressurised hydraulic fluid to the hollow interior 20 of the diaphragm carrier 17, it is necessary merely to connect the conduit 36 to the pump via the delivery conduit 40, by switching over the three-way valve 38.

The volume of hydraulic fluid supplied can be additionally reduced by restricting the return flow of fluid during the descent of the diaphragm carrier 17. Thus, by using a variable constrictor valve, the initial pressure applied to the batch of wet washing can be increased. Moreover, in order to shorten the duration of the pressing operation, a jet pump can be provided in the lower region where the maximum supply of hydraulic fluid occurs.

As the diaphragm 18 descends onto the flange 13 of the charging frame 6 and seals thereagainst, a certain volume of air is enclosed in the indented portion 19 of the diaphragm. During the pressing operation, this enclosed air acts as a compensator cushion, and also helps with the "drying" process, since any air which escapes through the batch of washing "blows out" residual moisture.

I claim:

1. A press for extracting water from wet washing, the press comprising a housing, a perforated press floor for supporting a batch of wet washing, a charging frame for surrounding the batch of wet washing supported by the perforated press floor, a hydraulic ram for pressing the wet washing down against the press floor, the hydraulic ram comprising a generally bell-shaped diaphragm carrier whose open end is closed by a diaphragm and whose hollow interior is pressurizable with hydraulic fluid, and means for moving the charging frame together with the diaphragm carrier as a unit towards the press floor.

2. A press according to claim 1, wherein the charging frame includes a tubular wall provided with an outwardly-extending sealing flange at its upper end.

3. A press according to claim 1, wherein means are provided for locking the diaphragm carrier to the charging frame for conjoint downwards movement.

4. A press according to claim 1, wherein means are provided for locking the diaphragm carrier in its lowest position.

5. A press according to claim 4, wherein said locking means comprise hydraulic ram means attached to the diaphragm carrier which engage stop members attached to the housing of the press.

6. A press according to claim 5, wherein a pair of hydraulic piston-and-cylinder units constitute said hydraulic ram means, each of said piston-and-cylinder units having a pair of piston rods extending in opposite directions from its cylinder, and the two piston rods extending in each direction being connected to a respective stop which co-operates with a corresponding stop member attached to the housing.

7. A press according to claim 6, wherein the housing includes a pair of oppositely disposed side walls.

8. A press according to claim 7, wherein each side wall supports a respective stop member which extends substantially the entire width of that wall.

9. A press according to claim 8, wherein each stop member is constituted by a pair of vertically spaced rails.

10. A press according to claim 1, wherein the charging frame is vertically reciprocable by means of double-acting hydraulic piston-and-cylinder units.

11. A press according to claim 10, wherein the charging frame is guided for vertical reciprocation on a pair of pillars positioned at a first pair of diagonally-opposed corners of the housing.

12. A press according to claim 11, wherein the diaphragm carrier is vertically reciprocable by means of double-acting piston-and-cylinder units.

13. A press according to claim 12, wherein the diaphragm carrier is guided for vertical reciprocation on a pair of pillars positioned at a second pair of diagonally-opposed corners of the housing.

14. A press according to claim 13, wherein the charging frame and the diaphragm carrier are each provided with sets of rollers for engaging their respective pairs of pillars.

15. A press according to claim 1, further comprising a reservoir of hydraulic fluid and a conduit leading from the reservoir to the hollow interior of the diaphragm carrier.

16. A press according to claim 15, wherein the upper edge of the reservoir is positioned beneath the lower edge of the diaphragm when the diaphragm carrier is in its lowest position.

17. A press according to claim 1, wherein the diaphragm is flexible and bows into the hollow interior of the diaphragm carrier.

18. A press according to claim 1, further comprising an expeller device for removing the washing from the press floor when the water extraction process has finished.

19. A press according to claim 18, wherein the expeller device is constituted by a curved arm pivotally mounted on the housing just above the level of the press floor.

* * * * *